United States Patent [19]

Falce et al.

[11] Patent Number: 4,587,455

[45] Date of Patent: May 6, 1986

[54] CONTROLLED POROSITY DISPENSER CATHODE

[75] Inventors: Louis R. Falce, Marina Del Rey; Glenn S. Breeze, Lomita, both of Calif.

[73] Assignee: Hughes Aircraft Company, Los Angeles, Calif.

[21] Appl. No.: 736,965

[22] Filed: May 21, 1985

Related U.S. Application Data

[63] Continuation of Ser. No. 433,586, Oct. 12, 1982, abandoned.

[51] Int. Cl.[4] ..... H01J 1/14; H01J 9/04

[52] U.S. Cl. ..... 313/346 DC; 313/346 R; 445/50; 445/51; 427/77

[58] Field of Search ..... 313/346 R, 346 DC; 445/50, 51; 427/77, 78, 124

[56] References Cited

U.S. PATENT DOCUMENTS

| | | | |
|---|---|---|---|
| 3,244,930 | 4/1966 | Stutsman | 313/346 R |
| 3,290,543 | 12/1966 | Weissman | 313/346 R |
| 3,531,679 | 9/1970 | Katz | 313/346 R |
| 3,662,789 | 5/1972 | Koo et al. | 445/50 X |
| 3,813,571 | 5/1974 | Basiulis | 313/346 R X |
| 4,101,800 | 7/1978 | Thomas et al. | 313/346 DC |
| 4,302,702 | 11/1981 | Montgaillard et al. | 445/50 X |
| 4,310,603 | 1/1982 | Falce | 313/346 DC X |
| 4,310,775 | 1/1982 | Heynisch | 313/346 DC X |
| 4,371,809 | 2/1983 | Thomas et al. | 313/346 DC X |
| 4,379,979 | 4/1983 | Thomas et al. | 313/346 DC X |

*Primary Examiner*—David K. Moore
*Assistant Examiner*—Vincent DeLuca
*Attorney, Agent, or Firm*—Robert Thompson; Kenneth W. Float; A. W. Karambelas

[57] ABSTRACT

An emitter-dispenser housing for a controlled porosity dispenser cathode manufactured of a single material as a unitary piece by a chemical vapor deposition process in which a configured mandrel is coated with a layer of material such as tungsten, for example, so that when the mandrel is removed from the coating of material a hollow housing is formed having a side wall and an end wall which define a reservoir. In addition, intersecting strips of this same material as the coating, which had been placed in the mandrel, extend transversely across the reservoir with the edges thereof atomically bonded to the coating during the chemical vapor deposition to form a unitary piece. Thereafter an array of apertures is formed in the end wall of the housing by laser drilling to create an emitter-dispenser.

21 Claims, 9 Drawing Figures

CONTROLLED POROSITY DISPENSER CATHODE

The Government has rights to this invention pursuant to Contract Number N00014-81-C-2245.

This application is a continuation of Ser. No. 06/433,586 filed Oct. 12, 1982, now abandoned.

TECHNICAL FIELD

This invention relates to control porosity dispenser cathodes and methods for making the same.

BACKGROUND OF THE INVENTION

This invention is a further advance pertaining to the structure of and the method for fabricating controlled porosity dispenser cathodes.

Thermionic emission cathodes of the type that can be used in microwave tubes such as travelling wave tubes are, in many applications, required to have high reliability and long life. It is also desirable that all areas of the cathode surface be operated in a space charge limited mode for more stable operation.

Conventional cathodes, such as the "B", the "S" and the "M" types, are made of random porosity structures impregnated with barium calcium aluminate compounds and generally tend to provide a non-uniform emission over the surface of the cathode. The result is that excessive temperatures are required to assure that space charge limited emission is achieved in less active areas of the cathode surface. Consequently, the more active areas become excessively hot resulting in decreased reliability and shortened life. The end result is that emission is gradually reduced as the pores become depleted of the impregnant. Examples of these types of cathodes are disclosed in U.S. Pat. No. 2,700,000, issued on Jan. 18, 1955 to R. Levi et al and U.S. Pat. No. 2,722,626, issued on Nov. 1, 1955 to P. P. Coppola et al.

In order to attain the goals of long life and reliability, a number of approaches have heretofore been used. Previously, a thin layer of porous metal was formed directly on the emitting surface of the reservoir of activating material such as by evaporation in a vacuum, by electroplating or by vapor deposition. These approaches are disclosed in U.S. Pat. No. 3,155,864, issued to P. P. Coppola on Nov. 3, 1964 and in U.S. Pat. Nos. 3,243,637 and 3,243,638 issued to J. H. Affleck III on Mar. 29, 1966.

Shortcomings in these approaches are that the porosity of the emitter surface is random rather than precise and coating directly to the activating material could block many of the pores.

One of these more recent approaches is disclosed in U.S. Pat. No. 4,101,800, issued on July 18, 1978 to R. E. Thomas wherein a reservoir of activating material is covered by a perforated metal foil. The perforations enable migration of electron emitting material from the reservoir of activating material to the foil surface to coat the surface thereby providing a cathode surface of somewhat uniform emissivity.

Subsequently, an advance was made in the fabrication of such structures as disclosed in U.S. Pat. No. 4,310,603, issued on Jan. 12, 1982 to L. R. Falce. In this approach, a perforated metal foil having an appropriate pattern of pore size apertures therein is formed. Thereafter, this foil is bonded to a generally cylindrical housing such as by brazing, welding or diffusion bonding.

Several disadvantages of this last approach are that: the high temperatures associated with the bonding process cause recrystallization of the foil material; the use of dissimilar brazing materials subject the foil surface to contaminates whereupon the foil has a non-uniform work function; and the braze material can block some of the apertures in the emitter surface. On top of this, the brazing or welding with unlike materials creates a distinct possibility that the bond will fail during thermal cycling. Moreover, fabrication of this kind of device requires a large number of hand processing steps.

SUMMARY OF THE INVENTION

In order to aid in the understanding of this invention, it can be stated in essentially summary form that it is directed to a structure for a controlled porosity dispenser cathode which is fabricated as a monolithic or integral piece essentially of a single material formed and integrally bonded together by a chemical vapor deposition process.

In essence, a mandrel is constructed of molybdenum with crossing slots formed in one end thereof. Tungsten strips are placed in these slots and are brazed in place with copper. The mandrel and strip assembly is then machined to the preferred configuration. Thereafter, the mandrel is placed in a chemical vapor deposition chamber and a thin coating of tungsten is deposited on the mandrel. Then, as required, the end of the mandrel is machined in a concave spherical radius configuration. At this time, the mandrel is returned to the deposition chamber where it receives an additional thin layer of tungsten.

After some additional machining the mandrel is then removed such as by etching it away, thereby leaving the hollow housing of tungsten which will serve as a reservoir for an activating material. This housing then has an array of apertures drilled in the contoured top surface such as by a pulsed laser thereby creating a precisely porous emitter-dispenser surface.

At this time, the reservoir of the structure can be filled from the open end with a barium calcium aluminate compound or other barium bearing compound that will decompose when heated, thereby supplying activating material to the emitter-dispenser surface through the array of apertures.

The filled housing can then be attached to a heater structure to make a complete dispenser cathode.

This housing is featured in that it is constructed of a single material wherein the crystalline-atomic bonding of the contoured top surface and the side walls of the housing forms an essentially monolithic or single piece. Several advantages include control over the crystalline orientation in the top surface member which becomes the emitter-dispenser surface and the fact that there is little likelihood of contaminates forming on the emission-dispenser surface during fabrication. Consequently, the work function of the surface is generally uniform whereupon there is a high degree of emission uniformity across this surface.

Another advantage is that the dispenser cathode can be operated at a lower temperature than other dispenser cathodes of the controlled porosity type as a result of the feature of the support-thermal cross members which tend to distribute the heat more deeply and uniformly into the activating material and to the emitter-dispenser surface. As a consequence, it is able to produce a higher emission density for a given temperature than was heretofore obtained and a more stable emission at these lower temperatures. Moreover, at these lower temperatures there is a lower evaporation rate thereby resulting in a reduced loss of the activating material barium and barium oxide (Ba+BaO).

Still another advantage is that the structure is not likely to delaminate or fail during thermal cycling as a result of its unitary and single material construction.

In addition, there is dimensional stability and lack of distortion in the emitter-dispenser surface which might otherwise result from thermal cycling.

The process and structure has the added manufacturing advantages that it: reduces the number of manufacturing steps; reduces the hand work required; is suitable for large scale production; allows very thin wall structures to be readily fabricated; and results in an easily replicated, precision structure.

Further purposes and advantages of this invention will become apparent from the study of the following detailed description, the attached drawings and the claims.

DETAILED DESCRIPTION OF THE INVENTION

Figure 1:
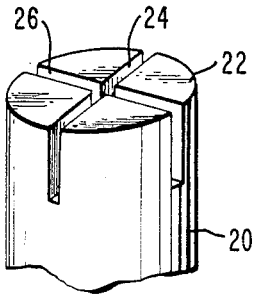
FIG. 1 is a schematic perspective view of a mandrel onto which a thin layer of tungsten or other metal to be coated.

Referring now to the drawings in more detail, FIG. 1 is illustrative of a first step of fabrication in which a mandrel is formed having a configuration generally similar to the configuration of the final emitter-reservoir housing. In this particular embodiment, the mandrel 20 is cylindrical and is made of molybdenum. It should be understood that the mandrel could be made of other materials which are capable of withstanding the temperatures at which the subsequent fabrication steps take place and which are otherwise compatible with these steps.

The end face 22 of the mandrel 20 is slotted with two intersecting slots 24 and 26 which extend into the body of the material at right angles to each other and are preferably both in a plane coextensive with or collateral with the axis of the mandrel. In this particular embodiment, the slots 24 and 26 extend across the diameter of the mandrel.

Figure 2:
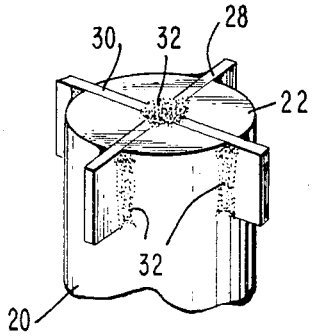
FIG. 2 is a schematic perspective view illustrating the cross member thermal-mechanical support brazed in place in the mandrel.

As illustrated in FIG. 2, intersecting strips 28 and 30 of tungsten 0.002 inches thick, which will eventually form thermal-support members, are slotted (not shown) to interlock together at their crossing point and are inserted into the slots 24 and 26. These strips are of the same material that the remainder of the emitter-reservoir housing will be made from. While tungsten is used in the preferred embodiment, it could be of any other material which has an attractive work function and which is capable of withstanding the operating temperature of the control porosity dispenser cathode over extended periods of time. These strips 28 and 30 are brazed together and in place by copper brazing material 32.

Figure 3:
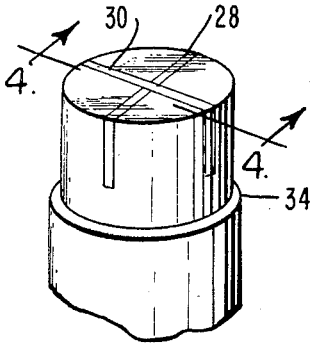
FIG. 3 is a schematic perspective view illustrating the mandrel machined to a configuration for chemical vapor deposition.

Thereafter, as illustrated by FIG. 3, the mandrel 20 is machined down to remove the surplus brazing material 32 and the edges of the strips 28 and 30 which protrude beyond the side and end surfaces of the mandrel 20 so that the strip edges are flush with the surface of the mandrel. In addition, in this particular embodiment, a shoulder 34 is formed.

Figure 4:
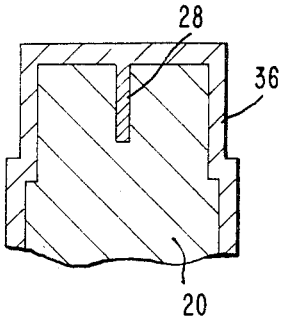
FIG. 4 is a cross-sectional side view taken along the line 4—4 of FIG. 3 showing the mandrel having a thin layer of metal deposited thereon.

As illustrated by FIG. 4, the mandrel 20 is subjected to chemical vapor deposition process in which a tungsten coating 36 (not drawn to scale) 0.004 of an inch thick is formed on the mandrel surface. During this chemical vapor deposition step, the edges of the strips 28 and 30 atomically bond to the tungsten coating 36.

This vapor deposition step can be accomplished in a quartz reaction chamber in which reactive gases of the tungsten metal compound will flow across the heated mandrel to form the deposited layer. Generally the heat for the mandrel can be supplied by an inductive type power supply and the flow rate of the gases can be controlled.

Figure 5:
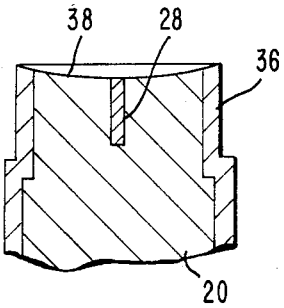
FIG. 5 is a cross-sectional view with the mandrel end surface contoured in a spherical radius, concave configuration.

Thereafter, as illustrated by FIG. 5, end surface 22 of the mandrel is machined into a spherical-radius concave surface 38 such as by electrical discharge machining. The particular radius and shape of this surface 38 is dependent upon the end application of the cathode and the type of beam focusing to be used. Thus, this surface 38 could have been left flat or have other configurations for certain types of applications and beam focusing.

Figure 6:
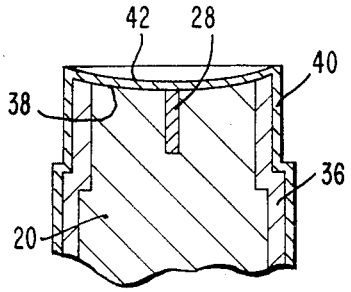
FIG. 6 is a cross-sectional view illustrating a second thin layer of metal deposited thereon to form the emitter-dispenser surface and to thicken the side wall of the emitter-reservoir housing.

As illustrated by FIG. 6, another thin layer of tungsten 40 is formed upon the exposed surface of the first tungsten coating 36 and the exposed mandrel concave surface 38 by means of the chemical vapor deposition process. The term "thin" as used herein is about 0.001 of an inch thick in the preferred embodiment. However, it could also be somewhat less or somewhat greater depending upon the structural integrity of the layer or upon the ease at which the electron emitting material is to migrate to the emitting surface. For example, the range could be between about 0.0005 of an inch and 0.0005 of an inch or, in some cases, more. Care must be taken to be sure that this layer is not so thin that the activating material will readily evaporate or so thick that the activating material will not readily migrate to the emitter surface through the pores to be formed.

During the vapor deposition, the two layers of tungsten 36 and 40 bond together by atomic crystalline growth to form a monolithic or single piece of a single material with a somewhat thickened side wall. In addition, the tungsten coating which forms the concave emitter-dispenser 42 atomically bonds to the exposed edges of the strips 28 and 30 which form the mechanical-thermal supports. These strips serve to hold the thin wall emitter-dispenser 42 in its precise configuration and will subsequently serve to distribute heat into an activating material as well as the emitter surface.

Figure 7:
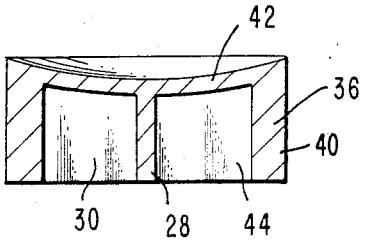
FIG. 7 is a cross-sectional view of the hollow emitter-reservoir housing with the mandrel removed.

As illustrated by FIG. 7, the end segment of the mandrel 20 holding the configured tungsten coating is cut off at about a plane coextensive with the lower edges of strips 28 and 30, and the molybdenum mandrel 20 is removed such as by a differential solvent thereby forming a hollow housing with a reservoir 44 formed therein. One differential solvent which has been found to be effective is nitric acid which etches the molybdenum and any remaining copper brazing material 32 but does not significantly affect the tungsten.

Of course, if, as previously stated, other materials are used for the mandrel 20, or the housing 48, it may be necessary to use another differential solvent. In addition, it would be possible to configure the mandrel 20 such that it can be readily withdrawn from the assembled housing. One way that this could be accomplished would be by tapering the side wall of the mandrel and coating it with graphite thereby enabling the mandrel to be easily withdrawn. Moreover, there are other possible approaches that can be used.

Figure 8:
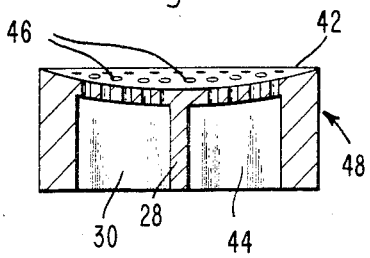
FIG. 8 is a cross-sectional view representing the housing of FIG. 7 with the emitter-dispenser surface thereof drilled to form an array of apertures.

As illustrated by FIG. 8, an array of apertures 46 is formed through the emitter-dispenser 42 in open communication with the reservoir 44. It is preferable that these apertures be of small diameter, closely spaced and in a precise pattern. Accordingly, one way that these apertures have been formed is by laser drilling in which apertures 5.0 microns in diameter on 15.0 micron centers have been formed. This results in a precisely porous emitter-dispenser 42.

Figure 9:
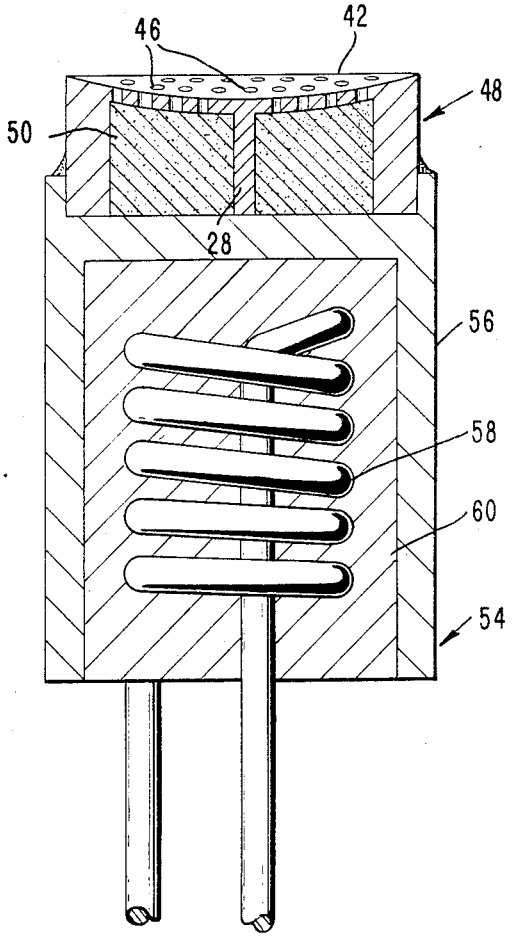
FIG. 9 is a cross-sectional schematic illustration of a control porosity dispenser cathode including the housing filled with activating material and a heater assembly attached thereto.

Thereafter, as further illustrated in FIG. 9 the reservoir 44 of the hollow emitter-dispenser housing 48 is filled with an activating material 50 through the open end thereof. One activating material 50 which has been found to be particularly useful is a mixture of 80% by weight of barium calcium aluminate having a 5:3:2 mole ratio and 20% by weight of tungsten powder. Of course, other barium bearing compounds that will decompose when heated to supply activating material to the emitter surface of the emitter-dispenser 42 can be used.

As further illustrated in FIG. 9, a controlled porosity dispenser cathode 52 is formed by attaching the filled emitter-dispenser housing 48 to a heater assembly 54.

The heater assembly 54 includes a hollow support member 56 made of a high temperature material such as tungsten which encloses a heater coil 58 potted in a thermally conductive material 60 such as aluminum oxide $Al_2O_3$. The emitter-reservoir housing 48 is affixed to the end thereof such as by brazing. Thereafter, heat from the heater coil 58 is conducted to the activating material 50 thereby causing barium and barium oxide to migrate both along the interspace between the emitter-dispenser 42 and the activating material 50 and directly through the apertures 46 to the emitter surface of the emitter-dispenser 42 thereby continuously replenishing the activating material on the surface as it is used up during electron emission. As previously stated, the strips 28 and 30 also provide thermal conductivity into the activating material 50 and to the emitter surface thereby providing for efficient operation of the overall device.

Thus, although the invention has been shown and described with respect to specific methods and embodiments, nevertheless, various changes and modifications obvious to a person skilled in the art to which the invention pertains are deemed to lie within the purview of the invention.

What is claimed is:

1. A method for fabricating a dispenser-reservoir housing for a controlled porosity dispenser cathode comprising the steps of:

coating the side surface and adjacent end surface of a configured metal mandrel with a first metal coating which atomically bonds to said mandrel by means of crystalline growth into a unitary piece;

removing the mandrel to form a housing of the first metal coating having a side wall and an end wall which define a reservoir; and forming an array of apertures through the end wall in open communication with the reservoir to form an emitter surface.

2. The method of claim 1 in which the step of coating the mandrel includes: coating the mandrel with a first layer of metal;

removing the first layer of metal from the end surface of the mandrel;

configuring the end surface of the mandrel; and coating the mandrel with a second layer of the metal which is atomically bonded to the first layer of metal.

3. The method of claim 1 in which the step of coating is by chemical vapor deposition.

4. The method of claim 1 in which the metal coating is tungsten.

5. The method of claim 1 in which the metal coating on the end surface of the mandrel has a crystalline orientation which enhances uniform electron emission.

6. The method of claim 1 including the step of positioning at least one strip of a metal that is the same as the metal coating within the configured mandrel such that its exposed edges atomically bond to the metal coating to form an integral piece therewith extending transversely across the reservoir.

7. The method of claim 6 in which the at least one strip includes at least two intersecting strips.

8. The method of claim 1 which the end surface of the mandrel is configured into a concave spherical surface.

9. The method of claim 1 in which the array of apertures are laser drilled.

10. The method of claim 1 in which the step of removing the mandrel is by differential etching which dissolves the material of the mandrel but does not significantly etch the material of the housing.

11. The method of claim 2 in which the step of coating is by chemical vapor deposition.

12. The method of claim 2 in which the coating material is tungsten.

13. The method of claim 2 in which the coating material on the end surface of the mandrel has a crystalline orientation which enhances uniform electron emission.

14. The method of claim 2 including the step of positioning at least one strip of a material that is the same as the coating material within the configured mandrel such that its exposed edges atomically bond to the coating material to form an integral piece therewith extending transversely across the reservoir.

15. The method of claim 2 in which the end surface of the mandrel is configured into a concave spherical surface.

16. The method of claim 2 in which the array of apertures are laser drilled.

17. The method of claim 2 which the step of removing the mandrel is by differential etching which dissolves the material of the mandrel but does not significantly etch the material of the housing.

18. The method of fabricating a controlled porosity cathode structure having a spherical emitting surface with apertures therein of closely controlled size and spacing including the steps of:

providing a metal mandrel having a curved end surface and side walls extending therefrom;

vapor depositing a high temperature resistant metal coating on said curved end surface and said side walls;

forming apertures of chosen size and spacing in said curved end surface;

removing said mandrel leaving a cavity having interior walls of said high temperature resistant metal coating; and filling said cavity with a selected activating material, whereby said mandrel serves to define the geometry of said cavity in addition to maintaining structural integrity of said metal coating during the process of fabricating said cathode structure.

19. The method defined in claim 18 wherein said mandrel is made of molybdenum and said high temperature resistant metal coating is tungsten.

20. The method defined in claim 19 wherein said metal coating is formed by successively depositing thin layers of tungsten on said mandrel to thereby carefully control the thickness of the tungsten layer on the curved end surface of said mandrel and thereby control the dispensation of ions leaving said activating material and passing through apertures in the curved end surface of said cathode structure.

21. The method defined in claim 19 wherein said metal coating is formed by successively depositing thin layers of tungsten on said mandrel to thereby carefully control the thickness of the tungsten layer on the curved end surface of said mandrel and thereby control the dispensation of ions leaving said activating material and passing through apertures in the curved end surface of said cathode structure.

* * * * *